US005711822A

United States Patent [19]

Burgett

[11] Patent Number: 5,711,822

[45] Date of Patent: Jan. 27, 1998

[54] METHOD AND APPARATUS FOR CLEANING CONNECTORS

[75] Inventor: Mark Edward Burgett, High Point, N.C.

[73] Assignee: Lucent Technologies Inc., Murray Hill, N.J.

[21] Appl. No.: 683,523

[22] Filed: Jul. 12, 1996

Related U.S. Application Data

[62] Division of Ser. No. 346,663, Nov. 30, 1994, abandoned.

[51] Int. Cl.[6] ..... B08B 3/02

[52] U.S. Cl. ..... 134/27; 134/25.4; 134/169 A; 134/102.2

[58] Field of Search ..... 134/169 A, 166 R, 134/201, 102.2, 40, 25.4, 26, 28, 27; 123/198 A

[56] References Cited

U.S. PATENT DOCUMENTS

| | | | |
|---|---|---|---|
| 4,716,673 | 1/1988 | Williams et al. . | |
| 4,733,678 | 3/1988 | Bolois . | |
| 4,756,337 | 7/1988 | Settineri . | |
| 4,768,531 | 9/1988 | Broussard . | |
| 4,780,333 | 10/1988 | Smith et al. . | |
| 4,784,170 | 11/1988 | Romanelli et al. | 134/169 A |
| 4,901,464 | 2/1990 | Banoun . | |
| 5,379,542 | 1/1995 | Guzman . | |
| 5,392,796 | 2/1995 | Coleman | 134/169 A |
| 5,464,096 | 11/1995 | Hurwitz . | |
| 5,470,750 | 11/1995 | Bar-Or . | |

*Primary Examiner*—Frankie L. Stinson

[57] ABSTRACT

A method of uncoupling, cleaning, refurbishing, and reassembling electrical connectors which have been exposed to environmental hazards, particularly underwater operation, and a kit therefore.

25 Claims, 1 Drawing Sheet

METHOD AND APPARATUS FOR CLEANING CONNECTORS

This application is a division of application Ser. No. 08/346,663 filed Nov. 30, 1994 abandoned.

BACKGROUND OF THE INVENTION

1. Field of the Invention

This invention relates to a method of cleaning electrical connectors and in particular to cleaning underwater connectors and a kit of tools for cleaning these connectors and reassembling them.

2. Description of Related Art

Electrical connectors are necessary to provide communications services in a variety of exposed environments such as telephone poles, manholes, and in underwater applications. The latter are particularly critical because of their inaccessibility, and the high cost of a replacement operation.

Typical applications of underwater connectors include the military, underwater research, and oil exploration and drilling. Problems arising in installing, maintaining, or re-connecting these deep submergence connectors are due to the presence of abrasive sand particles, corrosive salt particles, and the need to withstand pressure up to 10,000 pounds per square inch. This pressure is usually accommodated by an O-ring seated within a groove in the connector. The connector can be no better than the integrity of this O-ring or its seat and conventional tools found around repair ships or drilling rigs can easily damage the O-ring or the connector. Conventional solvents used to clean connectors have included methyl chloroform and chlorofluorocarbons which can break down in the stratosphere to deplete the ozone layer.

Accordingly, there is an increased need to provide procedures to install, maintain, and re-couple environmentally exposed connectors and to provide a convenient package of tools which increases the service life of these connectors, maintains their reliability, and protects the environment from damaging chemicals which may be used in cleaning the connectors.

SUMMARY OF THE INVENTION

The present invention relates to a kit and a method for cleaning and maintaining electrical connectors which have been exposed to hostile environments such as telephone poles, manholes, or salt water.

In one embodiment of the invention, a kit is provided which includes means for unfastening the connector, means for removing pressure seals without damaging the connector parts, a solvent for removing grease, water for dissolving salts, means for drying the connector parts, a replacement seal and a lubricant therefore.

In another embodiment of the invention, the kit includes a spanner wrench which is adapted to engage a coupling ring of the connector, means for removing the O-ring, a container of a methyl polysilioxane fluid for removing grease, a container of distilled, de-ionized water, a container filled with a gas for removing dust, a lint-free cloth, an O-ring to fit within the connector and a lubricant for it.

In a further embodiment of the invention, the kit includes a spanner wrench adapted to engage the coupling ring, an orange stick adapted to remove the O-ring, a microduster comprising a container of gas, under pressure, a lint-free cloth, a container of solvent, a container of isopropyl alcohol, a container of distilled, de-ionized water, an O-ring adapted to fit within a groove in the connector, a lubricant for the O-ring, safety goggles to protect the eyes of a technician, gloves to protect the connector from human contamination, a hand magnifying glass, and a flashlight.

The present invention also relates to a method of cleaning a connector wherein it is first rinsed with water to remove mud and sand, dried, and its coupling removed, The plug and receptacle are then separated, a solvent is applied to the contacts to remove grease, water is applied to remove chemical salts, and alcohol is applied to remove the water. A new pressure seal is selected from the kit, coated with a lubricant from the kit, and installed with the aid of a tool from the kit. The plug and receptacle are then re-connected and a coupling ring is fastened with a spanner wrench from the kit.

The previously described versions of the present invention have many advantages including extending the service life of the connector, and improving the maintainability by having all the tools and materials assembled together in one convenient package. Another advantage is that the reliability of the pressure seal is ensured by supplying a wooden tool which will not mar the surface which mates with the pressure seal. A further advantage is the use of a solvent which will not deplete the ozone layer or contribute to global warming.

These and other features and advantages of the invention will be better understood with consideration of the following detailed description of the preferred embodiments.

DETAILED DESCRIPTION OF THE PREFERRED EMBODIMENTS

Figure 1:
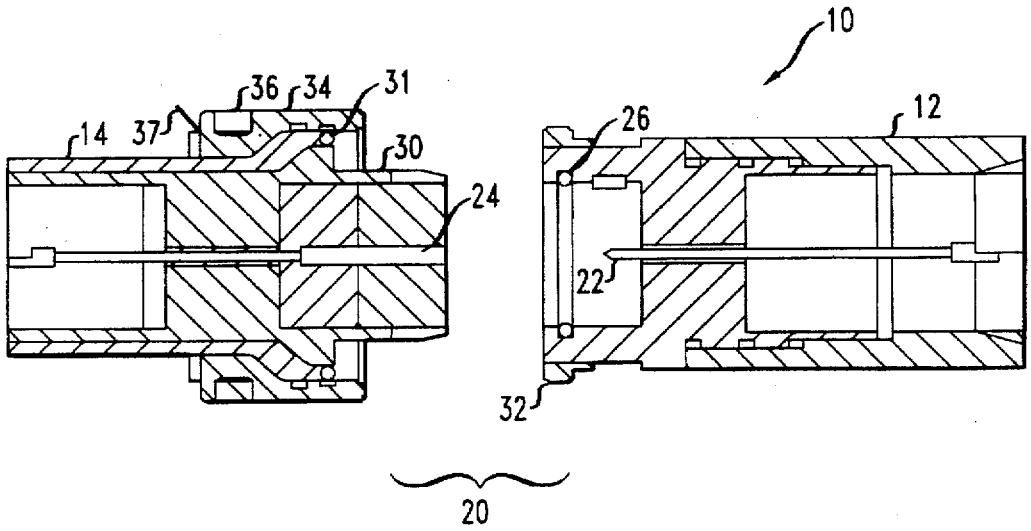
FIG. 1 is a cross sectional view of an exemplary prior art connector, upon which the present invention method can be practiced with the described kit.

Referring to FIG. 1 there is shown a prior art underwater connector 10 of the type conforming to military specification No. MIL-C-24217. The connector 10 is comprised of a male plug connector 12 and a female receptacle connector 14 that join together. For the purposes of this description the male plug connector 12 and female receptacle 14 connector are together referred to as a connector pair 20. The male plug connector 12 includes at least one male connector contact 22. The female receptacle connector 14 includes a corresponding number of female connector contacts 24 that receive the male connector contacts 22 when the connector pair 20 are joined. The male connector contact 22 contains an internal O-ring 26 that seals against a neck region 30 of the female receptacle connector 14 when the connector pair 20 is joined. A threaded region 32 is disposed on the exterior of the male plug connector 12.

The female receptacle connector 14 contains a large O-ring 31 seated within the confines of a coupling ring 34. The coupling ring 34 engages the threaded region 32 on the male plug connector 12, thereby mechanically joining the female receptacle connector 12 to the male plug connector 12. The coupling ring 34 has blind holes 36 disposed along its exterior to provide a means for engaging and turning the coupling ring 34. A safety wire 37 is provided for a secondary connection between the male plug connector 12 and the female receptacle connector 14.

One embodiment of the invention method uses a kit for uncoupling, cleaning, refurbishing, and recoupling connectors which have been exposed to harmful environments such as telephone poles, manholes, or under water. The kit includes means for unfastening the connector pair 20. For reliable operation, the male plug connector 12 and female receptacle connector 14 are typically screwed to together to contact a pressure seal which may be in the form of an O-ring. The unfastening means may be a conventional wrench, but a preferred embodiment uses a spanner wrench with tines which are specifically adapted to fit within holes on a plug coupling ring 34, thereby avoiding damage to the coupling ring 34. Also provided is a means for removing a pressure seal. The pressure seal may have any configuration, but for circular connectors the most commonly used pressure seal is an O-ring 26, 31. The pressure integrity of the connector 10 is no better than the condition of this pressure seal or its seat in the connector body. Both are susceptible to mechanical damage if screwdrivers or metal tweezers are used to pry the pressure seal out of the connector 10. The preferred embodiment is an orange stick, a wooden stick about one-eighth inch in diameter with tapered ends which is a common tool used to probe electronic equipment. The kit also contains a solvent for removing grease or oil which may be on the connector contacts. Among the most effective solvents are the class of chlorofluorocarbons (sold under the tradename FREON) or methyl chloroform. These solvents have low surface tension, therefore penetrate well, leave no residue upon drying, and are very stable chemically. However, upon evaporation, they ultimately diffuse into the stratosphere where they decompose and liberate chlorine. This phenomenon is well known to deplete the earth's protective layer of ozone, so use of these solvents in open cleaning systems is being curtailed or eliminated by federal and state regulation. In a preferred embodiment, this invention uses a class of liquids known as methyl polysiloxanes, sold by Dow Corning, Midland, Mich. The life expectancy of these fluids in the atmosphere ranges from 10 to 30 days, after which they decompose into carbon dioxide, silicic acid, and water. Therefore, they do not damage the ozone layer or contribute to global warming. They also possess many of the desirable solvent and drying properties of the freons, and their surface tension and evaporation rate may be adjusted by selecting molecular weight. They are also chemically safe in that they are not corrosive, do not injure or sensitize skin, and are not genetically active. In a preferred embodiment the solvent to remove the grease is selected from types designated as OS-10, OS-20, or OS-30, which have surface tensions ranging from 15 to 18 dynes/cm.

The kit also provides distilled, de-ionized water to dissolve any salts which have accumulated in the connector 10 and means to dry the connector 10. The drying means may be an alcohol; the preferred embodiment being isopropyl alcohol.

In another embodiment of the invention elements added to the kit in addition to those recited above include the following. A container of gas under pressure, which gas is selected from those which do not damage the ozone layer, and preferably are selected from the class of chemicals known as hydoflourocarbons, HFCs, such as type 134A HFC. A lint-free cloth for removing grease. A pressure seal adapted to fit within a groove in the male plug connector 12 and female receptacle connector 14 and a lubricant for that pressure seal which is typically an O-ring.

In a further embodiment of the present invention, elements added to the kit in addition to those recited immediately above include the following: safety goggles to protect a technician, gloves to protect the connector from human contamination, a hand magnifying glass to inspect the connector contacts, and a flashlight.

The method of cleaning a connector 10 which has been exposed to hostile environmental conditions comprises the following steps. The connector pair 20 are rinsed with water to remove mud, sand, and salt. The connector pair 20 is blotted dry and remaining water droplets are blown away by a microduster containing HFC gas. A safety wire 36, if used, is removed and saved. The spanner wrench is next used to remove the plug coupling ring 34 to separate the male plug connector 12 from the female receptacle connector 14. The pressure seal, typically an O-ring 26, 31, is removed with the orange stick to avoid damaging the connector. The used O-ring 26, 31 is discarded. The microdusters and/or wipes and swabs are used to remove any water. A solvent, preferably a volatile siloxane fluid is applied to the connector contacts 22, 24 and the O-ring grooves to remove any grease. Distilled, de-ionized water is applied to dissolve any salts and alcohol is applied to evaporate the water droplets. The previous two steps may be repeated to ensure cleanliness. The microduster is used to blow away any residual alcohol from the contacts and O-ring grooves which are then inspected with the modifying glass and flashlight. A new O-ring is selected from the kit, lubricated, and installed with an orange stick. The male plug connector 12 and female receptacle connector 14 are next inspected for proper O-ring installation. Keyways in the male plug connector 12 and female receptacle connector 14 are aligned, the connectors are pushed together, and a coupling ring 34 is engaged and tightened with the spanner wrench. The following table provides a list of items which may be selected for the various embodiments of the kit and suppliers for replacement of these items within the kit.

APPENDIX A

CONNECTOR MAINTENANCE KIT INVENTORY

| Item No. | Qty | Equipment/Supplier |
|---|---|---|
| 1 | 1 | Safety Goggles<br>Part No. 56795T3<br>Mc-Master Supply Co.<br>6100 Fulton Industrial Blvd.<br>Atlanta, GA 30336<br>(403) 346-7000 |
| 2 | 3 | Armstrong Spanner Wrenches<br>Part No. 35-351, 34-357, 34-363<br>D. G. O'Brien<br>One Chase<br>Seabrook, NH 03874-0159<br>(603) 474-5571 |
| 3 | 50 | Orange Sticks<br>Part No. 217PR010<br>Techni-Tool<br>5 Appollo Road<br>Box 368<br>Plymouth Meeting, PA 19462<br>(610) 941-2400 |
| 4 | AR<br>AR<br>AR<br>AR | TX909 Lint Free Wipes<br>TX709 Swabs<br>TX710 Swabs<br>TX 2514, 7 cans of Microduster 3<br>Texwipe<br>650 E. Crescent Ave.<br>Box 575<br>Upple Saddle River, NJ 07458 |
| 5 | AR | OS-10 Fluid<br>Dow Corning<br>Midland, MI<br>(517) 496-6000 |
| 6 | AR | Isopropyl Alcohol<br>Carolina Biological<br>2700 York Road<br>Burlington, NC 27215<br>(910) 584-0381 |

APPENDIX A-continued

CONNECTOR MAINTENANCE KIT INVENTORY

| Item No. | Qty | Equipment/Supplier |
|---|---|---|
| 7 | AR | Distilled De-Ionized Water<br>Carolina Biological |
| 8 | AR | O-Ring Lube<br>Parker Seal Co.<br>P.O. Box 11751<br>Lexington, Kentucky 40512-1751<br>(606) 269-2351 |
| 9 | 1 | Hand Magnifying Glass<br>Part No. 8485T13<br>Mc Master-Carr Supply Co. |
| 10 | 1(pair) | Rubber Gloves<br>Part No. 5278T4 |
| 11 | 1 | Mc Master-Carr Supply Co.<br>Flashlight<br>Part No. 1072T35<br>Mc Master-Carr Supply Co. |

"AR" Notes as required

Changes and modifications in the specifically described embodiments can be carried out without departing from the scope of the invention. In particular, the elements in the table above may be arranged in a variety of ways, and enclosed in a variety of packages, such as foam lined cases.

I claim:

1. A method of cleaning a connector of the type having a male plug and a female receptacle joined together by a coupling ring, wherein the male plug and the female receptacle contain electrical contacts and each contains an O-ring set in a groove for sealing against the other, said method comprising the steps of:

cleaning the exterior of said connector;

separating said male plug and said female receptacle;

removing each said O-ring;

cleaning said electrical contacts with a grease solvent;

cleaning said electrical contacts with a salt solvent;

cleaning said electrical contacts with a compressed gas;

replacing each said O-ring; and reconnecting said male plug and said female receptacle.

2. The method according to claim 1, wherein said salt solvent is distilled water and said method further includes the step of fully removing said distilled water from said electrical contacts after its application thereto.

3. The method according to claim 2, wherein said step of fully removing said distilled water includes evaporating said water with compressed gas.

4. The method according to claim 2, further including the step of applying alcohol to said electrical contacts after said distilled water to assist in evaporating said distilled water from said electrical contacts.

5. The method according to claim 1, further including the step of cleaning each O-ring groove with a lint free cloth.

6. The method according to claim 5, further including the step of cleaning each O-ring groove with compressed gas.

7. The method according to claim 1, wherein said grease solvent includes volatile siloxane fluid.

8. The method according to claim 1, wherein said compressed gas includes a hydrofluorocarbon.

9. The method according to claim 1, wherein said step of cleaning the exterior of said connector includes rinsing the exterior of the connector with distilled, deionized water to remove contaminants from the exterior of the connector.

10. The method according to claim 9, further including the step of drying said connector prior to separating the male plug and female receptacle.

11. The method according to claim 1, wherein said step of separating said male plug and said female receptacle includes disconnecting said coupling ring.

12. The method according to claim 1, wherein said grease solvent is a methyl polysiloxane.

13. The method according to claim 1, further including the step of lubricating each O-ring used during said step of replacing each said O-ring.

14. The method according to claim 1, further comprising the step of providing a portable connector cleaning kit, and wherein each of said grease solvent, said salt solvent and said compressed gas is selected from said connector cleaning kit prior to use in its respective cleaning step.

15. The method according to claim 14, further comprising selecting from said kit a wrench for separating and reconnecting said male plug and said female receptacle.

16. The method according to claim 15, wherein said wrench is a spanner wrench.

17. The method according to claim 14, further comprising selecting from said kit a lint free cloth for cleaning each O-ring groove.

18. The method according to claim 17, wherein said kit further includes safety goggles, gloves and a magnifying glass.

19. The method according to claim 17, wherein said kit further includes a flashlight.

20. A method of cleaning electrical contacts, comprising the steps of:

cleaning said electrical contacts with a grease solvent;

cleaning said electrical contacts with a salt solvent;

cleaning said electrical contacts with alcohol to remove said salt solvent; and evaporating said alcohol with a compressed gas.

21. The method according to claim 20, wherein said grease solvent is a methyl polysiloxane.

22. The method according to claim 20, wherein said compressed gas includes a hydrofluorocarbon.

23. The method according to claim 20, wherein said salt solvent is distilled water.

24. The method according to claim 20 wherein said grease solvent includes volatile siloxane fluid.

25. The method according to claim 20, further comprising the step of providing a portable connector cleaning kit, and wherein each of said grease solvent, said salt solvent, said alcohol and said compressed gas is selected from said connector cleaning kit prior to use in its respective cleaning and evaporating step.

* * * * *